US007364249B2

(12) United States Patent
Uji et al.

(10) Patent No.: US 7,364,249 B2
(45) Date of Patent: Apr. 29, 2008

(54) INK JET RECORDING APPARATUS AND INK JET RECORDING METHOD

(75) Inventors: Ayako Uji, Tokyo (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 11/144,705

(22) Filed: Jun. 6, 2005

(65) Prior Publication Data

US 2005/0270322 A1 Dec. 8, 2005

(30) Foreign Application Priority Data

Jun. 8, 2004 (JP) ..... 2004-170462

(51) Int. Cl.
*B41J 29/38* (2006.01)

(52) U.S. Cl. ..... 347/14; 347/17

(58) Field of Classification Search ..... 347/14, 347/17, 19

See application file for complete search history.

(56) References Cited

U.S. PATENT DOCUMENTS 6,213,579 B1 * 4/2001 Cornell et al. ..... 347/14

6,641,242 B2 * 11/2003 Canti et al. ..... 347/14

FOREIGN PATENT DOCUMENTS

| | | |
|---|---|---|
| JP | 3-234629 | 10/1991 |
| JP | 4-70348 | 3/1992 |

* cited by examiner

*Primary Examiner*—Thinh Nguyen
(74) *Attorney, Agent, or Firm*—Fitzpatrick, Cella, Harper & Scinto

(57) ABSTRACT

An ink jet recording apparatus is provided that changes the adjustment temperature of a recording head depending on the number of recording media so that a favorable recording result can be maintained for any number of recording media and a time required for the recording can be reduced. Different adjustment temperatures T2 are used depending on the number of recording media. When the number of recording media is relatively small, T2 is determined to be low and, when the number of recording media is relatively large, then T2 is determined to be high. When the recording is started, when the head temperature is lower than the determined temperature T2, then ink is heated by a sub heater. Depending on the determined temperature, an interval with which a preliminary ejection is performed is changed.

6 Claims, 13 Drawing Sheets

INK JET RECORDING APPARATUS AND INK JET RECORDING METHOD

BACKGROUND OF THE INVENTION

1. Field of the Invention

The present invention relates to an ink jet recording apparatus. In particular, the present invention relates to an ink jet recording apparatus, and an ink jet recording method therefor, for performing the ejection control of a recording head.

2. Description of the Related Art

As an example of an apparatus for performing a recording using a recording head including a plurality of recording elements, an ink jet recording apparatus having a plurality of ejection openings for ejecting ink has been known.

In order to keep ink ejection stability and/or constant ink ejection amount in the ink jet recording apparatus, the temperature of ink in the recording head is one of very important parameters. Specifically, ink properties such as the viscosity or surface tension change depending on the ink temperature. The ejection status also changes depending on the change of the ink property. Ink viscosity is particularly high in a low temperature environment, which may cause the ejection to be unstable to deteriorate the recording quality. In order to always maintain stabilized ejection, ink in the apparatus in some cases is heated to have a predetermined temperature when the recording is started. To achieve this, such a structure is frequently employed that heaters are provided at the interior and/or exterior of the recording head. When ink is not ejected for a long time period, solvent in the vicinity of the ejection opening evaporates to increase the ink viscosity, which inevitably causes the deterioration of the ejection status when the ejection is resumed. To get long the maximal time between a time prior has been completed and a time the next ejection can be performed in a preferred status (hereinafter referred to as "first-ejection time"), a recovery operation such as a preliminary ejection is performed, in the middle of the recording or prior to the start of the next recording, by ejecting a certain amount of ink outside the recording medium until ink can be ejected correctly.

For example, Japanese Patent Application Laid-Open No. 3-234629 (1991) discloses a structure in which, until a head temperature reaches a predetermined temperature after the apparatus power source is turned on, a driving pulse applied to the head is changed depending on the head temperature to warm-up the apparatus. Another structure is disclosed in Japanese Patent Application Laid-Open No. 4-070348 (1992) in which, in order to increase the head temperature to a fixed temperature more rapidly, an electrothermal transducer element (ejection heater) for generating thermal energy used for ink ejection is applied, depending on a temperature detected at the turning ON of the power source or the cancellation of the preheating, with an electric signal at which ink is not ejected so that the element generates heat.

Representative ink jet recording apparatuses include: the serial type one in which a recording head is scanned on a recording medium in a predetermined direction to perform recording; and the full line type one in which a recording head having a width equal to or larger than the width of the recording medium (hereinafter referred to as "line head") is used to perform recording. The line head does not scan a recording medium as in the case of the serial type recording head and performs recording to the recording medium on the line basis. Thus, the line head requires a shorter time for recording a predetermined amount when compared to the case of the serial type one and has a main objective of a high-speed recording.

The preliminary ejection in the serial type recording apparatus is frequently performed in places for the preliminary ejection that are provided exterior to the recording region (e.g., cap, preliminary ejection receipt). Thus, when the preliminary ejection must be performed in the middle of recording, the recording head is once moved to outside the recording region to perform a preliminary ejection, during which the recording is interrupted. As a result, a time required for recording a predetermined amount is increased. Furthermore, the ejected ink is waste ink, thus increasing, when the preliminary ejection is performed with a higher frequency, the amount of waste ink.

The full line type recording apparatus, having the main objective of providing a high-speed printing as described above, is desirably prevented from having a lower recording rate as much as possible. In view of the above, the present applicant suggests a mechanism through which a preliminary ejection is not performed outside the recording region but is performed on a belt for transporting a recording medium. However, the mechanism in which the preliminary ejection is performed on a belt requires the belt to be cleaned because ink left on the belt contaminates the recording medium. This belt cleaning is performed as required in the middle of the recording, thus causing the time required for the recording to be prolonged in order to provide the cleaning. Ink preliminarily ejected to the belt is waste ink as in the case of the serial type one.

As described above, in both of the serial type one and the full line type one, the larger the number of preliminary ejections in the middle of the recording, the longer the period required for printing. Also, the larger the number of preliminary ejections, the more the amount of waste ink. Thus, in order to realize a high-speed recording with reduced wasteful ink consumption, the number of times at which the preliminary ejection is performed has been required to be reduced.

In order to reduce the number of times at which the preliminary ejection is performed, the recording head is desirably provided with a status favorable for ink ejection as long as possible. Specifically, if the first-ejection time becomes longer, the number of times at which the preliminary ejection can be reduced. An effective method for providing such a long first-ejection time is to adjust, during the recording operation, the temperature of the recording head to prevent the ink temperature in the head from being increased or reduced more than necessary. The adjustment of the temperature in the recording head is particularly effective for a prolonging first-ejection time because the bubble jet® type ink jet recording apparatus in which a nozzle includes a heater and this heater is heated to instantly generate air bubbles in the ink so that the pressure for generating air bubbles is used to eject ink may cause a case in which a continuous ejection operation causes a more-than-necessary temperature increase of the ink in the nozzle.

For controlling the ink temperature, a structure has been suggested in which the head includes, in addition to an ink ejection heater, a heat source such as a heat retention heater (sub heater) provided on the same substrate on which the ink ejection heater is provided. In this structure, this sub heater is driven to heat ink in a direct or indirect manner. Specifically, there is a method, for example, for detecting the ink temperature (head temperature) in a direct or indirect manner to drive the sub heater until the ink has a predetermined temperature so that power supply is interrupted when the ink has a temperature equal to or higher than the predetermined temperature and the power supply is resumed when the ink has a temperature equal to or lower than a predetermined temperature.

There is another method in which ink ejecting heaters are used to heat ink, and in which such step is repeated that power supply is performed based on a detected temperature of the recording head with a pulse width (short pulse) with which the ink is prevented from generating bubbles until the ink has a predetermined temperature and then interrupted when the ink has a temperature equal to or higher than the predetermined temperature.

Furthermore, another structure has been suggested in which the sub heater and the ejection heater are both used for controlling the ink temperature. In this structure, ink is heated by the ejection heater until the ink reaches a predetermined temperature, and once the ink has a temperature equal to or higher than the predetermined temperature, the sub heater is controlled such that the ink it further heated until the ink reaches a targeted temperature and then the resulting ink temperature is kept constant.

SUMMARY OF THE INVENTION

By the way, recording conditions are different depending on an image or a user's selection. For example, there may be conditions for printing images such as photographs on a few recording media or for printing a large amount of documents such as texts with a high speed. In any of these conditions, the recording is required to be performed with a desired image quality and with a speed as high as possible.

However, the conventional control system/technique for adjusting the temperature of a recording head does not starts the ink ejection until the ink temperature reaches a fixed temperature. In the case of ink that has a longer first-ejection time as the ink temperature increases, the time (t) during which a favorable ejection status can be maintained is increased as the ink temperature (T) increases as shown in FIG. 6. Specifically, the number of times at which the preliminary ejection is performed within a predetermined time period can be reduced as the ink temperature is increased. Thus, when a large amount of recording is performed continuously, the number of times at which the preliminary ejection is performed can be reduced if the ink temperature is maintained to be high, thus reducing the total time required for the recording.

On the other hand, a certain length of time is required to heat the ink in its cool status to have a temperature of 45° C. Thus, when a case where the ink temperature is set to be 25° C. is compared to a case where the ink temperature is set to be 45° C., the length of time from a time at which a recording start command is given to a time at which a recording is started (hereinafter referred to as "stand-by time") is longer in the case latter than the former case. Here, an apparatus for recording one recording medium in one second is assumed. When this apparatus is used to perform recording on five media, the apparatus requires five seconds for the recording. This means that all the media can be recorded while a favorable ejection status is maintained. In other words, if the small number of media is provided for printing, there naturally is a small possibility where the preliminary ejections are performed during printing of those media; therefore, even if the first-ejection time would be prolonged adjusting the ink temperature at a high rate, the number of the preliminary ejections will not change, so that such attempt will not give a noticeable effect to the total time period required for printing. Rather, the time during which the determined ink temperature is reached is increased to increase the stand-by time, which may cause a case where the total time required for the recording with the high ink temperature is longer than that when a low ink temperature is set.

As described above, the relation between the ink temperature and the total time required for the recording changes depending on the number of recording media. In spite of this change of relation, the conventional control method for adjusting a recording head temperature has maintained a fixed ink temperature without considering the number of recording media. This has caused a case where, the time required for the recording is increased depending on the number of recording media, thus failing to satisfy the demands of high-speed printing by users.

The present invention was made in view of the problems of the prior art as described above. The present invention can provide an ink jet recording apparatus in which the preset temperature of a recording head is changed depending on the number of recording media so that any number of recording media can be always provided with a favorable recording result while reducing the time required for the recording.

In a first aspect of the present invention, there is provided an ink jet recording apparatus for recording on recording media based on recording data by ejecting ink from a recording head, comprising:

determination means for determining, based on the amount of recording media to be recorded with the recording data, an adjustment temperature of the recording head; and recording control means for maintaining, during the recording operation, the recording head to have the determined temperature.

In a second aspect of the present invention, there is provided an ink jet recording method using an ink jet recording apparatus for recording to recording media based on recording data by ejecting ink from a recording head, comprising:

a determination step for determining, based on the amount of media to be printed with the recording data, an adjustment temperature of the recording head; and a recording control step for maintaining, during the recording operation, the recording head to have the determined temperature.

As described above, the use of the present invention changes, depending on the number of recording media, the temperature of a recording head during the recording operation. As a result, when a relatively small number of media is printed and thus a recovery processing such as a preliminary ejection needs not be performed in the middle of the recording, the recording operation can be started with a relatively low temperature, thus reducing the stand-by time. When a relatively large number of media is printed and thus a recovery processing such as a preliminary ejection needs to be performed in the middle of the recording on the other hand, the recording head can be maintained with a relatively high temperature, thus increasing the first-ejection time and maintaining a favorable ink ejection status for a long time to increase the interval during which the preliminary ejection is not required in the middle of the recording. As a result, the number of times at which the preliminary ejection is performed in the middle of the recording can be reduced, thus reducing the total time required for the recording. Thus, a favorable recording result can be maintained with any number of recording media while reducing the time required for the recording.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, embodiments of the present invention will be described with reference to the drawings.

Figure 1:
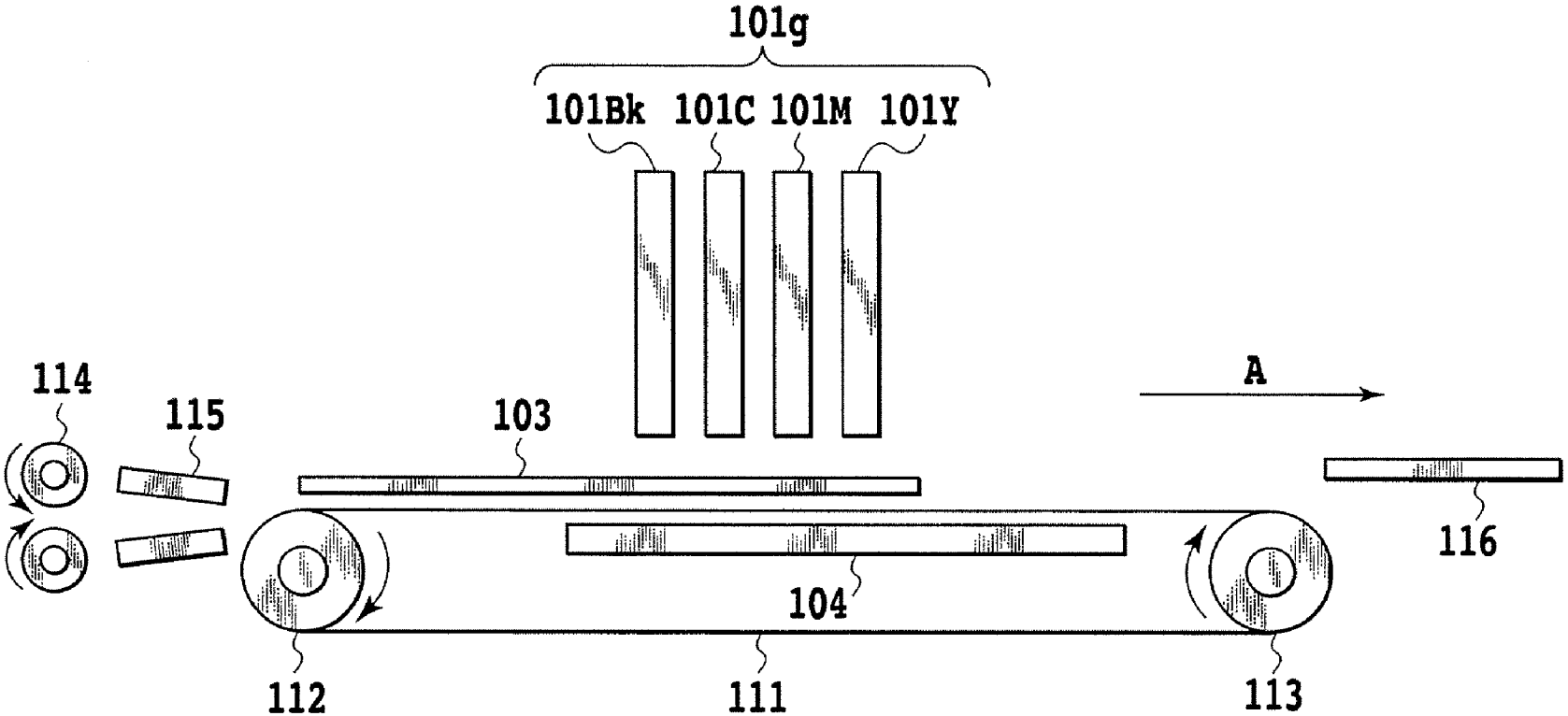
FIG. 1 is a schematic side view illustrating an ink jet recording apparatus of an embodiment of the present invention.

FIG. 1 is a side view illustrating the structure of an ink jet recording apparatus using a line head to which the present invention can be applied. This recording apparatus uses an ink jet print method in which a plurality of line heads 101*g* that are provided at predetermined positions and that are arranged in a direction along which a recording medium is transported (shown by the arrow A in the drawing) are used to eject ink for recording. This recording apparatus is controlled by a control circuit of FIG. 4 (which will be described later) to operate.

In each of the recording heads 101Bk, 101C, 101M, and 101Y of the head group 101*g*, about 14000 ink ejection openings are arranged with the density of 1200 dpi in a direction of the width of the recording medium 103 transported in the direction A of the drawing (i.e., in a direction perpendicular to the direction along which the recording medium is transported). The time required for performing the recording of one A4-size recording medium is one second at the maximum, providing the recording rate of 60 media/second. The recording can be provided to an A3-size recording medium at the maximum. The size of a recording head, recording rate, maximum recording region or the like are mere examples for the use of the present invention and do not limit the present invention.

The recording medium 103 is guided by a pair of guide plates 11 driven by a transportation motor. After a front edge of the recording medium 103 is detected, the recording medium 103 is transported by the transportation belt 111. The transportation belt 111 is an endless belt that is retained by two rollers 112 and 113. The displacement of the upper part in the longitudinal direction is restricted by the platen 104. The recording medium 103 is transported by allowing the roller 113 to be rotated. Absorption of the recording medium 103 toward the transportation belt 111 is performed by electrostatic absorption. The roller 113 is driven by a driving source such as a motor (not shown) to transport the recording medium 103 in the direction A. The recording medium 103 is printed by the head group 101*g* while being transported by the transportation belt 111 and is moved to the stacker 116.

In each recording head of the head group 101*g*, the head 101Bk for ejecting black ink and the heads for ejecting color ink (cyan head 101C, magenta head 101M, yellow head 101Y) are arranged as shown in the drawing along the direction A along which the recording medium 103 is transported. The respective recording heads eject ink of the respective colors so that black characters or color images can be printed.

Figure 2:
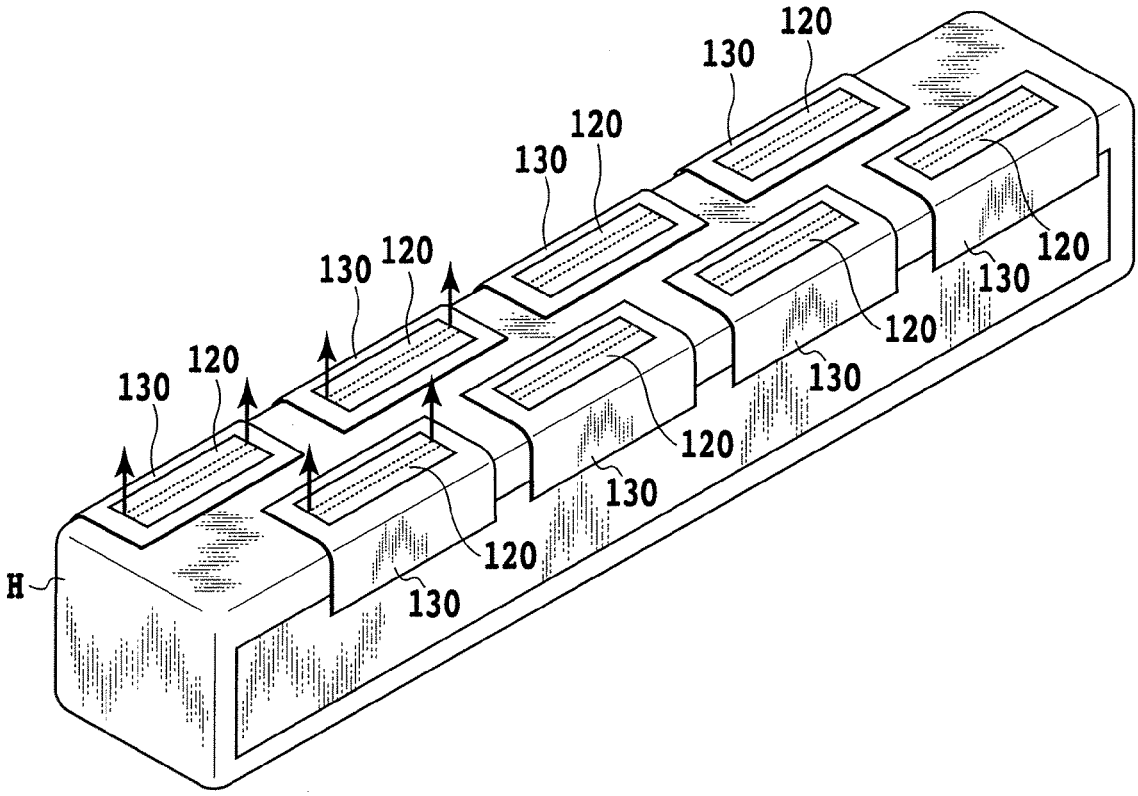
FIG. 2 is a perspective view illustrating an ejection opening face of a head cartridge.

FIG. 2 shows an example of the structure of the head cartridge H for one color in the recording head group 101*g* that can be included in the ink jet recording apparatus shown in FIG. 1.

In FIG. 2 the reference numeral 120 represents a recording element substrate for ejecting ink and the reference numeral 130 represents a flexible cable for supplying power to the recording element substrate. The cartridge H in this embodiment includes a plurality of recording element substrates 120 in order to have a higher recording rate. Although this embodiment shows a so-called line head in which a plurality of recording element substrates are arranged in a staggered manner so that nozzles are substantially arranged in the width direction of a recording medium, another line head also may be used in which one or two column(s) of nozzles is/are arranged. The arrows in FIG. 2 show the direction along which ink is ejected.

Figure 3:
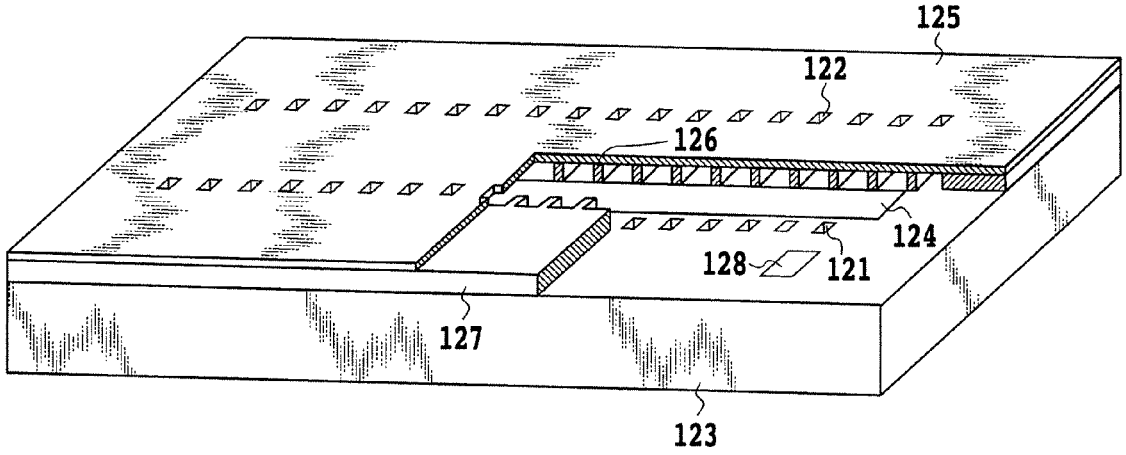
FIG. 3 is a partially broken perspective view illustrating the structure in the vicinity of ejection openings of a recording element substrate in the head cartridge H.

FIG. 3 shows the structure in the vicinity of the ejection openings of one recording element substrate in the cartridge H shown in FIG. 2.

The reference numeral 121 represents an electrothermal transducer element (ejection heater) for generating thermal energy that is used to eject ink in accordance with the power supply. The heaters 121 share the same substrate with a sub heater (not shown). The reference numeral 122 represents an ink ejection opening; the reference numeral 123 represents a substrate; the reference numeral 124 represents an ink supply opening for ink supplied from an ink tank; the reference numeral 125 represents a ejection plate on which the ink ejection openings 122 are provided; the reference numeral 126 represents a flow path wall for providing an ink flow path to each ink ejection opening; the reference numeral 127 represents a resin coating layer; and the reference numeral 128 represents a temperature sensor for detecting the temperature of the head.

Ink is filled in an ink flow path from the ink supply opening 124 to the ink ejection openings 122. Ink is heated by an ejection heater to have therein film boiling and the pressure generated by the bubble caused by the boiling is used to eject ink In the vicinity of the ink ejection openings 122.

Figure 4:
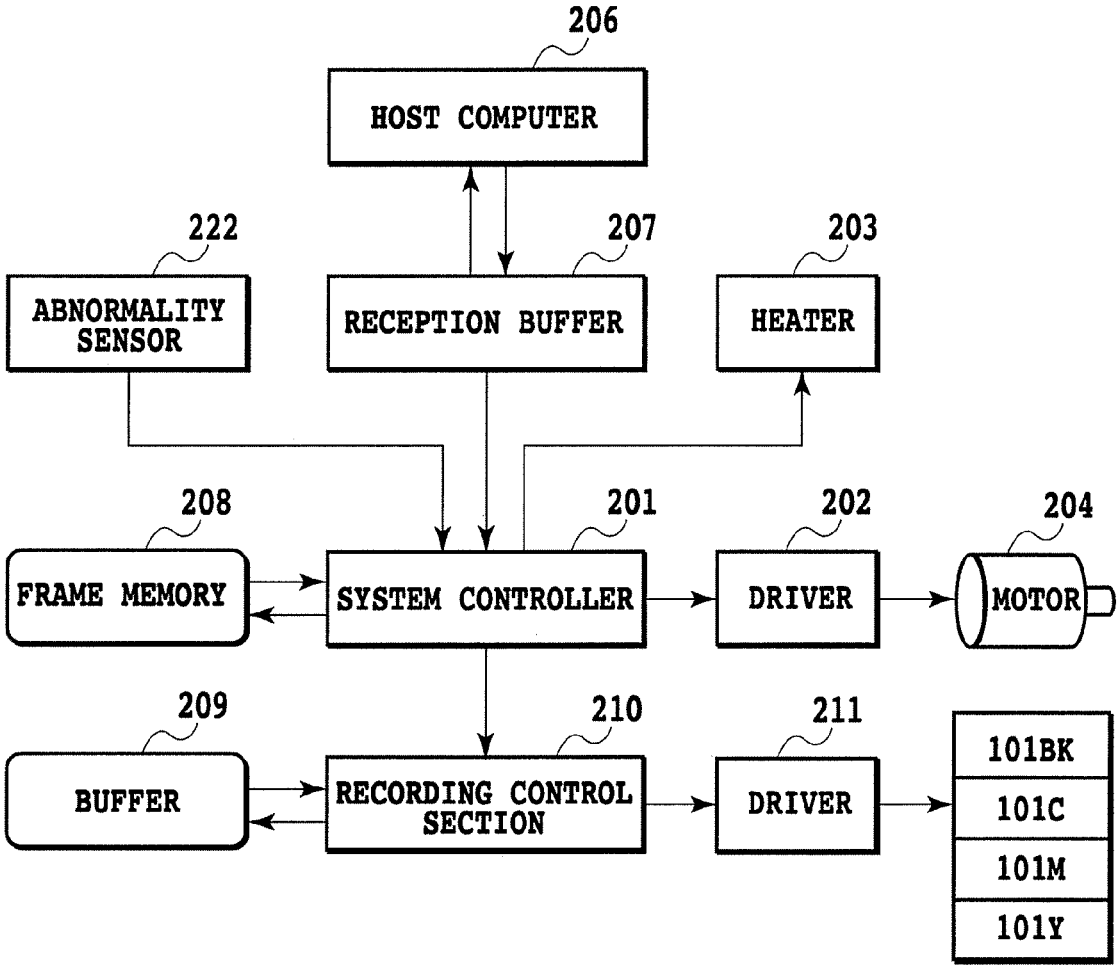
FIG. 4 is a block diagram illustrating an electric structure of an ink jet recording apparatus.

FIG. 4 is a block diagram illustrating the configuration of the control of the ink jet recording apparatus shown in FIG. 1.

The system controller 201 has a microprocessor, a ROM for storing a control program executed by this apparatus, and a RAM used as a work area by the microprocessor for a processing, for example. The system controller 201 controls the entire apparatus. The system controller 201 also controls the ink ejection and the heater for controlling the temperature of the recording head. The motor 204 is controlled to be driven by the driver 202 and rotates the roller 113 shown in FIG. 1 to transport a recording medium.

The host computer 206 transfers to-be-recorded information to the recording apparatus of this embodiment. The system controller 201 controls each driving section in the recording operation. The reception buffer 207 temporarily stores data from the host computer 206 in order to store the data until the data is read by the system controller 201. The frame memory 208 is a memory for developing to-be-recorded data into image data and is sized to store information required for the recording.

The buffer 209 temporarily stores to-be-recorded data and has the storage capacity that is determined depending on the number of ejection openings of the recording head. The print control section 210 appropriately controls the driving of the recording head by a command from the system controller 201 by controlling a drive frequency, the number of to-be-recorded data or the like and also prepares data for performing a preliminary ejection. The driver 211 drives the respective recording heads 101Bk, 101C, 101M, and 101Y for ejecting ink and is controlled by a signal from the recording control section 210.

In the configuration as described above, to-be-recorded data is transported from the host computer 206 to the reception buffer 207 and is temporarily stored. Next, the stored to-be-recorded data is read by the system controller 201 and is developed into the buffer 209. Abnormality such as paper jam, ink shortage, or paper shortage can be detected by various detection signals from the abnormality sensor 222.

Based on the image data developed in the buffer 209, the recording control section 210 controls the ejection operation of the respective recording heads.

In the ink jet recording apparatus having the structure as described above, in order to allow the recording head to have a status suitable for ink ejection, a control is provided to adjust the temperature of the recording head during the recording operation. This control intends to adjust the temperature of the recording head depending on the number of media to be printed so that the recording head can have a favorable status as long as possible even when the number of media to be printed is increased. This control method will be described by some embodiments.

With respect to the control method shown in the respective embodiments shown below, this method is applied to the full line type recording apparatus in the embodiments (except for the case of Embodiment 4). However, this control method may be used not only for the full line type recording apparatus but also for the serial type recording apparatus.

Embodiment 1

Figure 5:
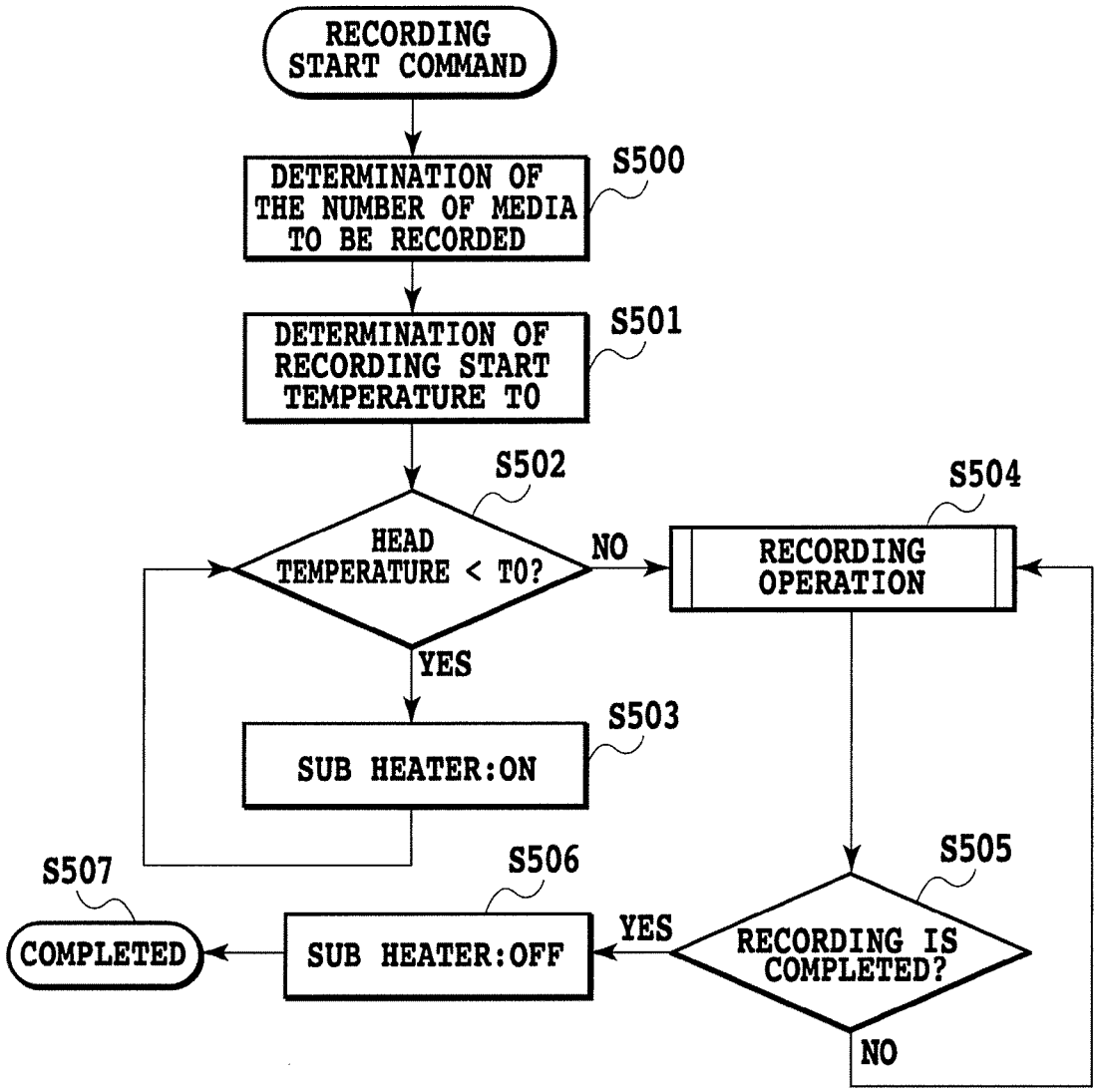
FIG. 5 is a flowchart illustrating a temperature adjustment control in Embodiment 1.

FIG. 5 is a flowchart illustrating the temperature adjustment control of a recording head in this embodiment.

Based on the to-be-recorded data and the recording start command sent from the host computer, the system controller starts the temperature adjustment control of the recording head. First, the number of recording media is determined based on the data to be recorded (Step 500) and the head temperature T0 at the start of the recording is determined depending on the number of recording media (Step 501). The head temperature T0 at the start of the recording is set in accordance with Table 1.

TABLE 1

| Number of recording media (X) | 1 to 5 | 6 to 10 | 11 to 20 | 21 to 30 | 31 to 40 | 41 - |
|---|---|---|---|---|---|---|
| Head temperature T0 at the start of the recording | 25° C. | 30° C. | 40° C. | 40° C. | 40° C. | 45° C. |

Specifically, the head temperature T0 at the start of the recording is set to be: 25° C. when the number of recording media is equal to or lower than 5; 30° C. when the number of recording media is 6 to 10; 40° C. when the number of recording media is equal to or 11 to 40; and 45° C. when the number of recording media is higher than 41. This uses a characteristic in which a longer ink temperature provides a longer the first-ejection time so that the number of preliminary ejections can be reduced when the number of recording media is increased.

Figure 6:
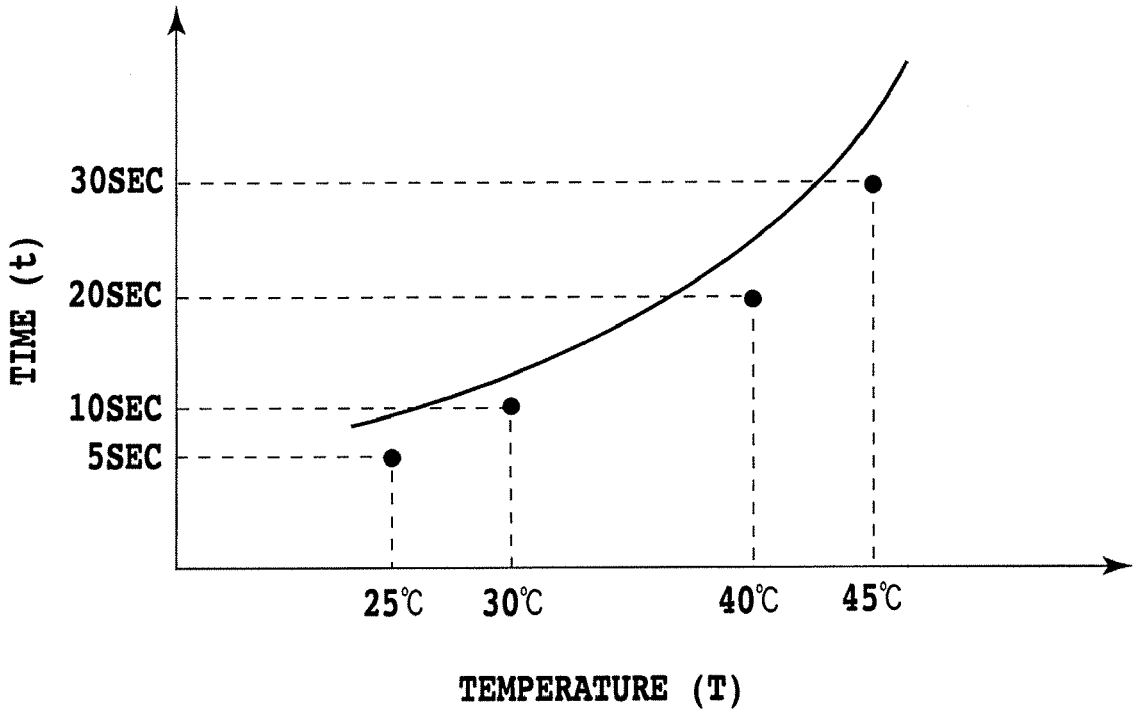
FIG. 6 is a graph illustrating the relation between a first-ejection time and a determined temperature for a head in the present invention.

FIG. 6 shows the relation between the temperature (T) of a recording head and the time (t) during which the ejection performance can be maintained.

As shown in FIG. 6, the head temperature of 25° C. can maintain only 5 seconds of a favorable ejection status while the head temperature of 45° C. can maintain as many as 30 seconds of favorable ejection status. Specifically, the head temperature of 25° C. requires a preliminary ejection to be performed every about 5 seconds while the head temperature of 45° C. only requires a preliminary ejection to be performed every about 30 seconds. Thus, a higher head temperature can increase the interval during which a preliminary ejection is not required, thus reducing the number of preliminary ejections required for printing the predetermined number of media to reduce the time required for the recording. At the same time, the time required for printing one medium is one second at the maximum. Thus, an operation for printing five or less media can be completed within five seconds during which a favorable ejection status is maintained, thus eliminating the need for performing the preliminary ejection in the middle of the recording. In view of the above, the head temperature at the start of the recording is previously set to be low to have 25° C., thereby reducing the time required for starting the recording.

With reference to FIG. 5 again, when the head temperature is lower than the recording start temperature T0 (Step 502), the sub heater is operated to heat ink (Step 503). Then, when the head temperature reaches the recording start temperature, the recording operation is started (Step 504). When the recording to the predetermined number of media is completed (Step 505), the sub heater is stopped (Step 506) and the processing is completed (Step 507).

At the respective recording start temperatures where the number of recording media is equal to or lower than 30, times during which the ejection performance can be maintained that are longer than the times until which the entire recording operation is completed. Thus, a preliminary ejection is not required in the middle of the recording. When the number of recording media is 31 to 40, the recording start temperature is set to be 40° C. and the belt is subjected to a preliminary election after the recording of 20 media, then the belt is subjected to a cleaning processing. When the number of recording media is equal to or higher than 41, the recording start temperature is set to be 45° C. and a preliminary ejection is performed after the printing of 30 media.

As described above, the above embodiment used such ink that gets longer the first-ejection time as the temperature is increased. In an embodiment of such ink, ink having the composition as shown below was used. The amount of the respective elements shown below is represented by the concentration by % by weight.

| | |
|---|---|
| Dye | 3 to 5% by weight |
| Diethylene glycol | 3 to 5% by weight |
| Acetylenol EH (manufactured by Kawaken Fine Chemicals Co., Ltd.) | 1.0% by weight |
| Water | Remaining part |

Figure 7:
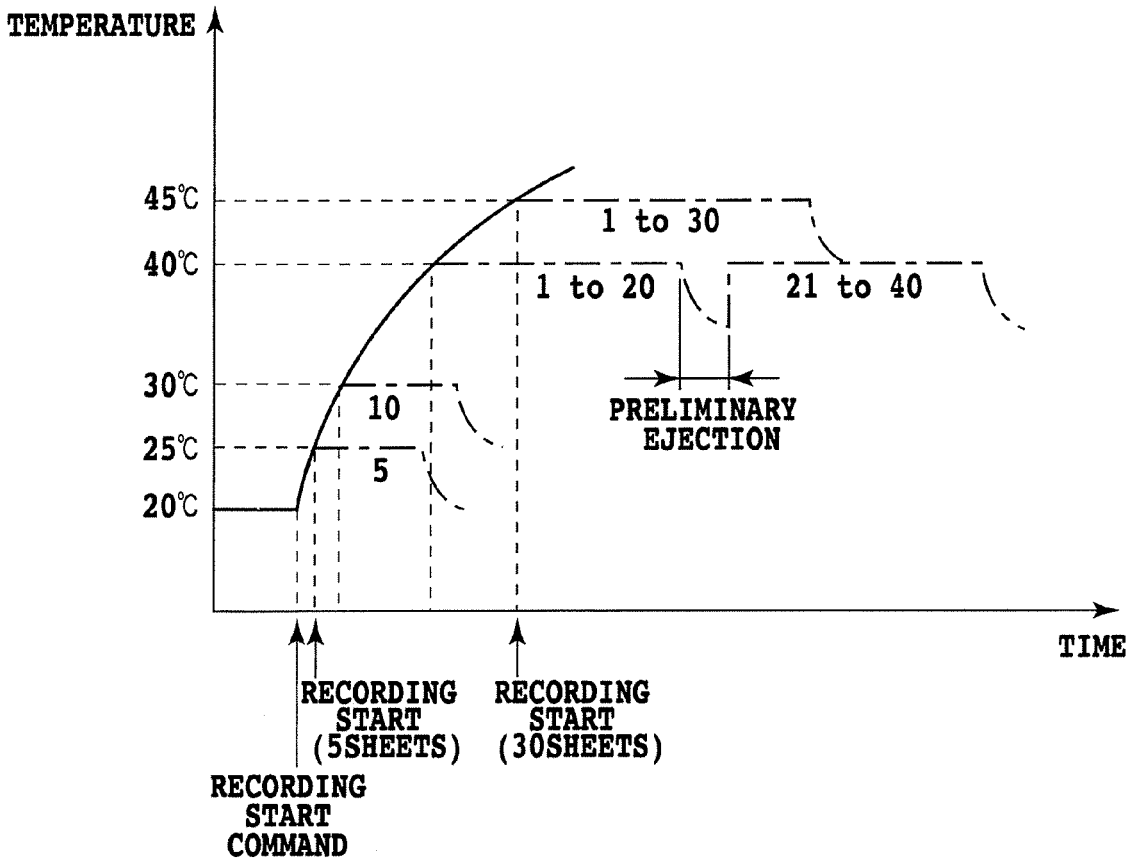
FIG. 7 is a graph illustrating the change of the head temperature due to heating and the head temperature at the start of the recording for each number of recording media.

FIG. 7 is a graph illustrating the head temperature at the start of the recording of the respective number of recording media and the change of the temperature thereafter. When the recording is completed, the temperature adjustment control is also stopped and thus the head temperature is reduced. When the number of recording media is 40, the preliminary ejection is performed after the recording of 20 media. However, the temperature adjustment control of the head is stopped during the preliminary ejection, thus lowering the head temperature during the preliminary ejection. Another control also may be used in which the temperature adjustment control of the head is not stopped even during the preliminary ejection.

Embodiment 2

In Embodiment 1, different recording start temperatures are used depending on the number of recording media so that the respective numbers of recording media can be subjected to a suitable temperature adjustment control. However, this control method requires, as the number of recording media is increased, a longer stand-by time until the start of the recording. Thus, Embodiment 2 uses a fixed recording start temperature T1 regardless of the number of recording media and an adjustment temperature T2 can be changed depending on the number of recording media, thus providing a fixed stand-by time.

Figure 8:
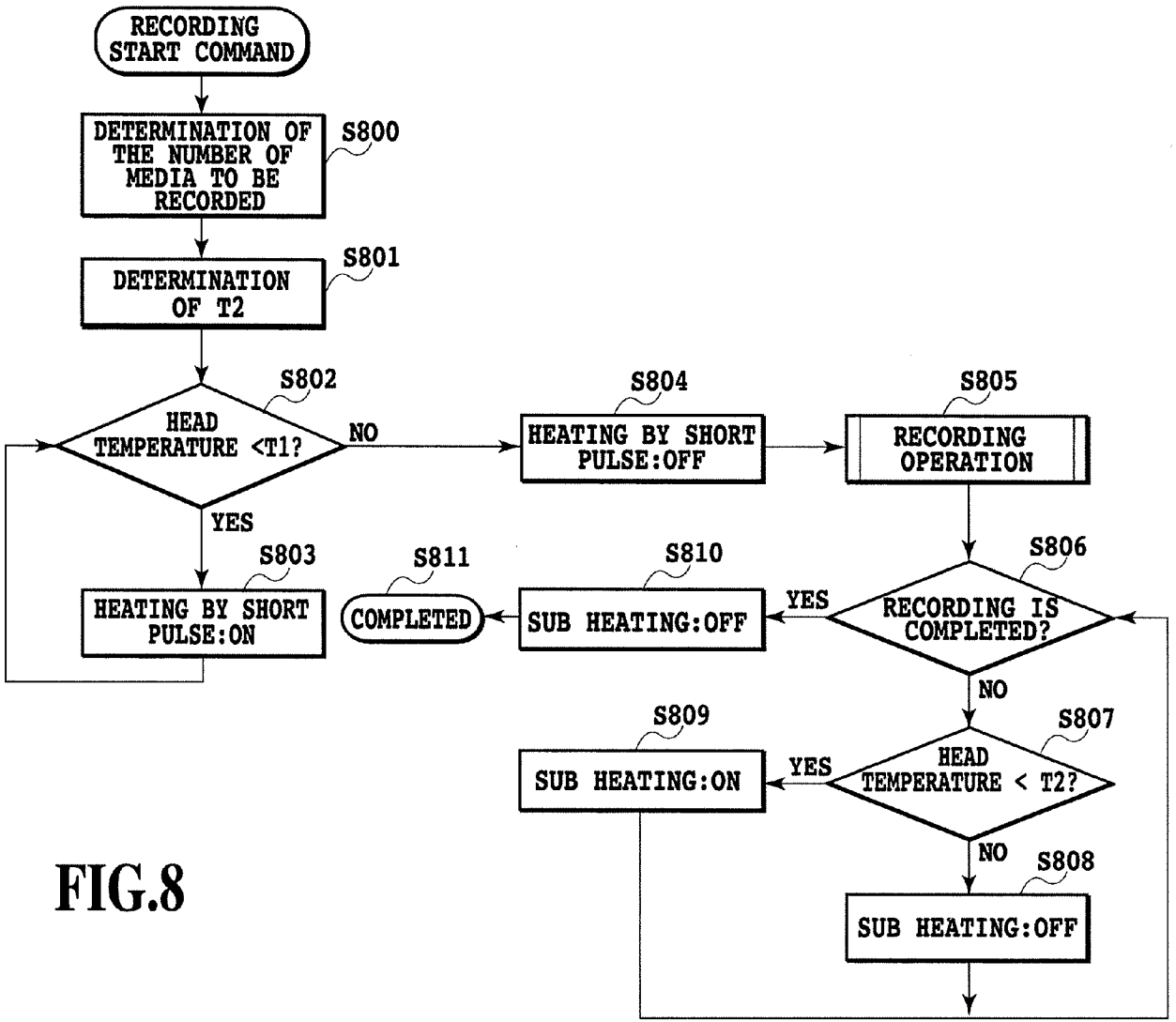
FIG. 8 is a flowchart illustrating the temperature adjustment control In Embodiment 2.

FIG. 8 is a flowchart illustrating the flow of the temperature adjustment control of Embodiment 2.

Embodiment 2 uses the same apparatus as that in Embodiment 1 in which the recording head includes, in addition to heaters for ink ejection, a sub heater for heating ink.

Embodiment 2 also uses ink as in Embodiment 1 that gets longer the first-ejection time as the temperature is increased. The respective head temperatures have a time during which a favorable ejection status can be maintained as shown in FIG. 6. The temperatures of the recording heads are changed in accordance with the temperature curve shown in FIG. 7.

Based on the to-be-recorded data and the recording start command sent from the host computer, the system controller starts the temperature adjustment control of the recording head. First, the number of recording media is determined based on the to-be-recorded data (Step 800). Then, the adjustment temperature T2 is determined based on the number of recording media (Step 801). This adjustment temperature T2 is determined in accordance with Table 2.

TABLE 2

| Recording start temperature | Adjustment temperature T2 in accordance with the number of media (X). | | | | | |
|---|---|---|---|---|---|---|
| T1 | 1 to 5 | 6 to 10 | 11 to 20 | 21 to 30 | 31 to 40 | 41 - |
| 25° C. | 25° C. | 30° C. | 40° C. | 40° C. | 40° C. | 45° C. |

In this embodiment, in addition to the adjustment temperature T2, the recording start temperature T1 is determined. The recording start temperature T1 is determined as 25° C. and the recording is started when the head has a temperature equal to or higher than 25° C.

Then, whether the head temperature reaches Ti or not is detected (Step 802). When the head temperature is lower than 25° C., a short pulse is sent to the ejection heater so that the ejection heater is driven for a time that is sufficiently short so that ink ejection is not caused, thus heating the ink (Step 803). When this heating operation provides the head temperature equal to or higher than T1, the heating by a short pulse is stopped (Step 804). Then, the recording operation is started (Step 805). In this embodiment, the recording start temperature T1 is 25° C. for any number of media, thus providing an almost constant stand-by time regardless of the number of recording media.

As described in Embodiment 1, when the number of recording is equal to or lower than 5, all of the recording is completed in a condition that a favorable ejection status is maintained. Thus, a preliminary ejection is not required in the middle of the recording. When the number of recording media is high on the other hand, a preliminary ejection is required in the middle of the recording. Thus, in order to reduce the number of preliminary ejections, the head must be subjected to a temperature adjustment control in accordance with the adjustment temperature.

When the head temperature does not reach the adjustment temperature T2 after the start of the recording operation (Step 807), the sub heater is driven to heat ink (Step 809). Then, the recording is continued in this status. When the head temperature reaches the adjustment temperature T2, the sub heater stops heating ink (Step 808). The sub heater also stops heating (Step 810), when the recording of the predetermined number of media is completed (Step 806). Then, the recording operation is completed (Step 811).

As described above, at the start of the recording, the recording is always started with the recording start temperature T1 regardless of the number of recording media. This can reduce the stand-by time and can prevent ink during the stand-by operation from being evaporated. During the recording operation, the head temperature is adjusted by the adjustment temperature T2 that is equal to or higher than the recording starts temperature T1. As a result, the total time required for the recording can be reduced for any number of recording media.

When the number of recording media is 20 for example, the recording is started when the head temperature reaches the recording start temperature T1 and the sub heater continues to heat ink even during the recording. As a result, the head temperature reaches 40° C. when the recording of about 5 media is completed, as shown in FIG. 7. The time during which a favorable ejection status is maintained is 20 seconds as can be seen from FIG. 6 and is longer than the time required for the recording of all 20 media. Thus, all 20 media can be recorded without requiring the preliminary ejection.

When the number of recording media is equal to or higher than 31, the preliminary ejection is required when the recording of 30 media is completed. However, the number of preliminary ejections can be reduced compared to the case where the adjustment temperature T2 is set to be lower than 45° C., thus reducing the total time required for the recording. The reduced number of preliminary ejections also can reduce the contamination of the belt when the preliminary ejection is performed on the transportation belt.

Embodiment 3

In Embodiment 2, described is the control in which a fixed recording start temperature is used while changing the adjustment temperature depending on the number of recording media. In the case of a large number of recording media (e.g. 100), the recording head is maintained to have 45° C. for a relatively long time. Then, the head requires a long time to have a low temperature even after the completion of the recording.

Generally, the ink jet head tends to have an increased ejection amount as the ink temperature is increased. Thus, when the head temperature is maintained to be high, the ejection amount is increased, increasing a possibility where dots having a large diameter are formed. Dots having a relatively large diameter are preferred for a text document because they increase the density but are not preferred in a high-precision image (e.g., photograph image) because they stand out too much. Thus, there may be a case where it is not preferable to print a large amount media to subsequently record a high-precision Image (e.g., photograph image) while the head having a high temperature. To prevent this, this embodiment will describe a control in which, the adjustment temperature T2 is reduced, in order to accelerate the decline of the head temperature after the printing of a large amount of 100 or more media, depending on the number of already-printed media.

Figure 9:
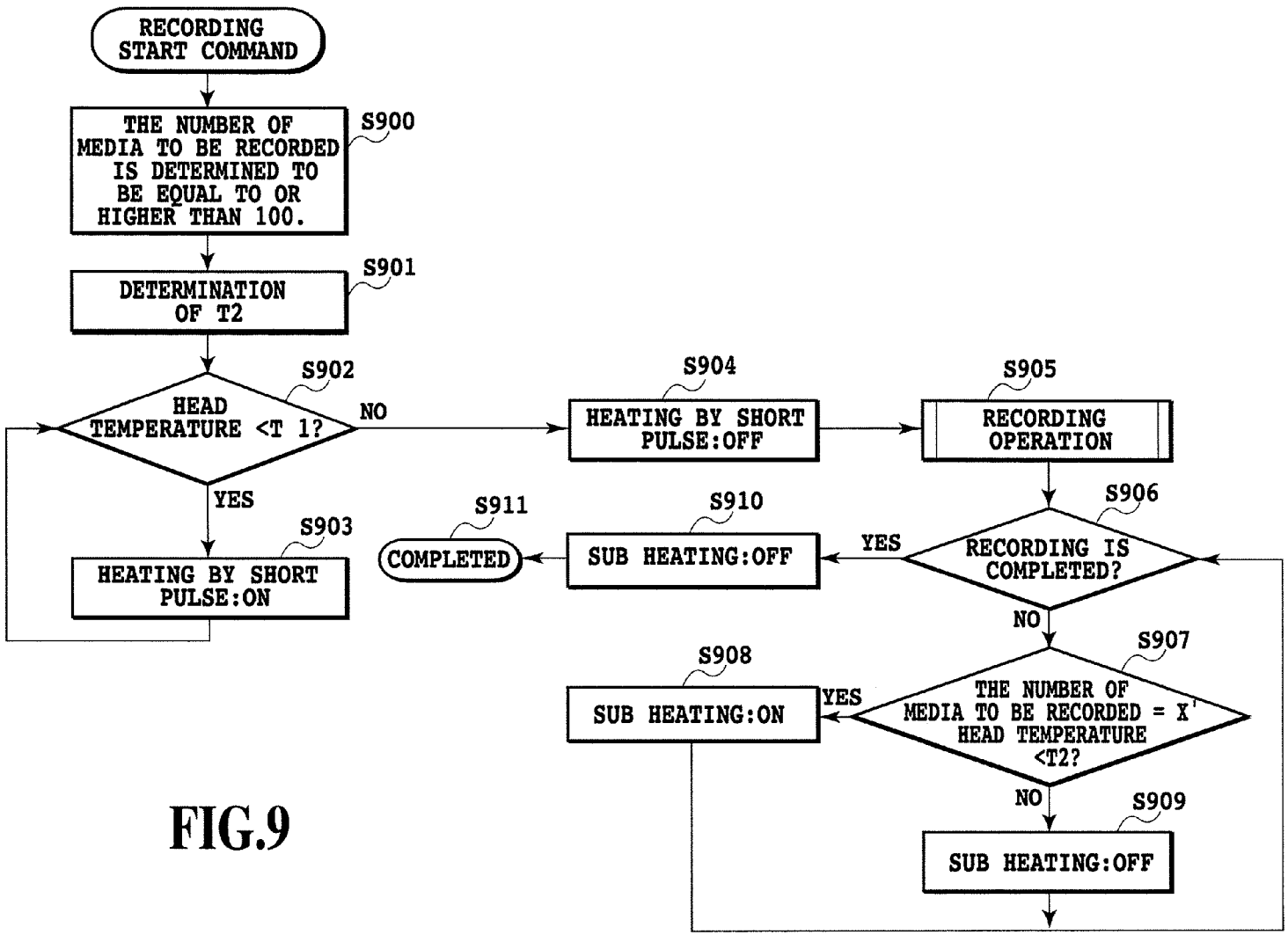
FIG. 9 is a flowchart illustrating the temperature adjustment control in Embodiment 3.

FIG. 9 is a flowchart illustrating the flow of the temperature adjustment control in this embodiment.

This embodiment also uses the same apparatus as that in embodiment 1 in which the recording head includes, in addition to heaters for ink ejection, a sub heater for heating ink.

Embodiment 3 also uses ink as in Embodiment 1 that gets longer the first-ejection time as the temperature is increased. The respective head temperatures have a time during which a favorable ejection status can be maintained as shown in FIG. 6. The temperatures of the recording heads are changed in accordance with the temperature curve shown in FIG. 7.

Based on the to-be-recorded data and the recording start command sent from the host computer, the system controller starts the temperature adjustment control of the recording head. First, the number of recording media is determined based on the to-be-recorded data (Step 900). The following section will describe a case where the number of recording medium is 100. The adjustment temperature T2 is determined depending on the number of media that has been already printed in a time from the start of the recording to the present time (Step 901). The adjustment temperature T2 is determined in accordance with Table 3. The adjustment temperature T2 has an Initial value of 45° C., as shown in Table 3.

TABLE 3

| Recording start temperature | Adjustment temperature T2 in accordance with the number of media (X') that has been already printed in a time from the start of the recording to the present time | | |
|---|---|---|---|
| T1 | 0 to 60 | 61 to 80 | 81 to 100 |
| 25° C. | 45° C. | 40° C. | 30° C. |

Then, whether the head temperature is reached at the recording start temperature T1 or not is detected (Step 902). When the head temperature is not reached, the ejection heater is driven with a short pulse that does not cause ink ejection to heat ink (Step 903). When the head temperature is equal to or higher than the recording the recording start temperature T1 (25° C.), then the heating by the short pulse is stopped (Step 904). Then, the recording operation is started (Step 905).

When the predetermined number of media (100 in this embodiment) has not yet recorded during the recording (Step 906), whether the head temperature reaches the adjustment temperature T2 or not is detected (Step 907). Then, every one medium among the number of media (X') that has been already printed is counted so that the adjustment temperature T2 is set to be 45° C. when the number of media that has been already recorded X' is lower than 60. When the head temperature is lower than 45° C., the sub heater is driven to heat ink (Step 908). When the head temperature is equal to or higher than 45° C., the sub heater is stopped to stop heating ink (Step 909).

The adjustment temperature T2 is changed as needed depending on the number of media that has been already recorded. For example, when the number of media that has been already recorded X' is equal to or higher than 61, then the adjustment temperature T2 is 40° C. and, when the number of media that has been already recorded X' is equal to or higher than 81, then the adjustment temperature T2 is 30° C. Then, the sub heater is controlled so that the head temperature is equal to the adjustment temperature T2.

Then, all of the recording is completed (Step 906). Then, the sub heater is stopped (Step 910), thus completing the recording operation (Step 911).

Figure 10:
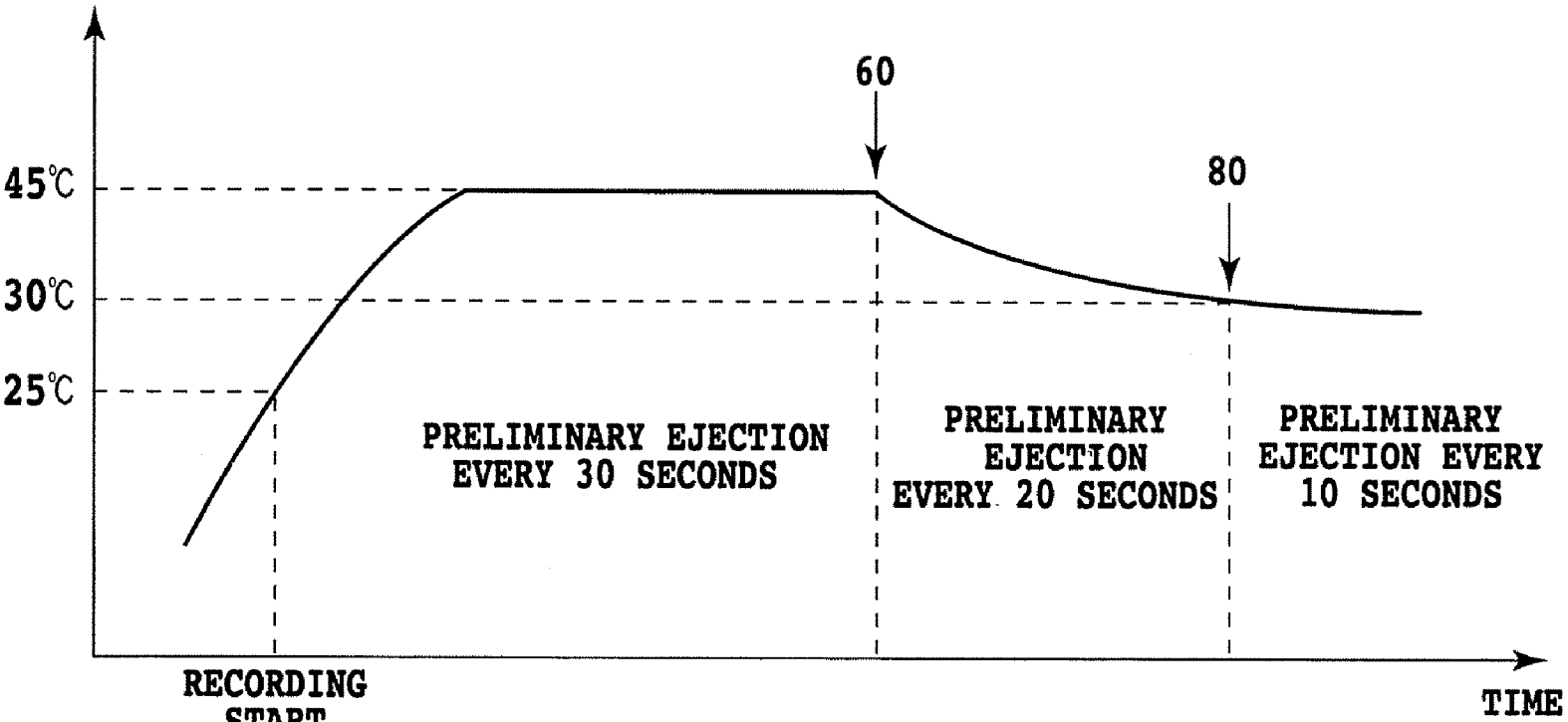
FIG. 10 is a graph illustrating the change of the head temperature and the number of preliminary ejections.

FIG. 10 shows the change of the temperature control of this embodiment.

As described above, a higher ink temperature tends to cause a longer first-ejection time. Thus, the number of preliminary ejections can be reduced if the adjustment temperature T2 is determined to be higher in accordance with the increase in the number of recording media. However, a high ink temperature requires the head to have a long time for cooling the head after the recording until a low temperature is reached. To prevent this, in order to rapidly cooling the head temperature to have a low temperature after the recording, this embodiment reduces the adjustment temperature T2 when the number of recorded media exceeds 60. The reduction in the head temperature shortens the ink ejection time and thus the interval 30 seconds between preliminary ejections to reduced to 20 seconds. Specifically, the interval between preliminary ejections is reduced. When the number of recorded media exceeds 80, the adjustment temperature T2 is further reduced and the interval between preliminary ejections is reduced to 10 seconds. As a result, the number of preliminary ejections to increased when compared to a control in which the adjustment temperature T2 is fixed to be 45° C. However, since such a control is provided when the number of recorded media exceeds 60, the number of not-yet-recorded media is about 40 and thus an increase in the number of preliminary ejections is not so high. Thus, the total time required for the recording shows only a small increase.

On the other hand, when a high-precision image is recorded immediately after the recording of a large amount of 100 media, a phenomenon can be prevented in which a not-yet-declined temperature causes an excessive ink ejection, thus promptly providing a recording with a suitable ejection amount of ink. Thus, this control routine is very effective for a case, for example, in which only a few media are printed, immediately after the recording of a large amount of text documents, to have thereon photograph image(s).

Embodiment 4

Although Embodiments 1 to 3 described the temperature adjustment control using the full line type recording head, the present invention provides the same effect not only to the full line type recording head but also to the serial type recording head. Embodiment 4 will describe a case where the present invention is applied to the serial type recording head.

Figure 11:
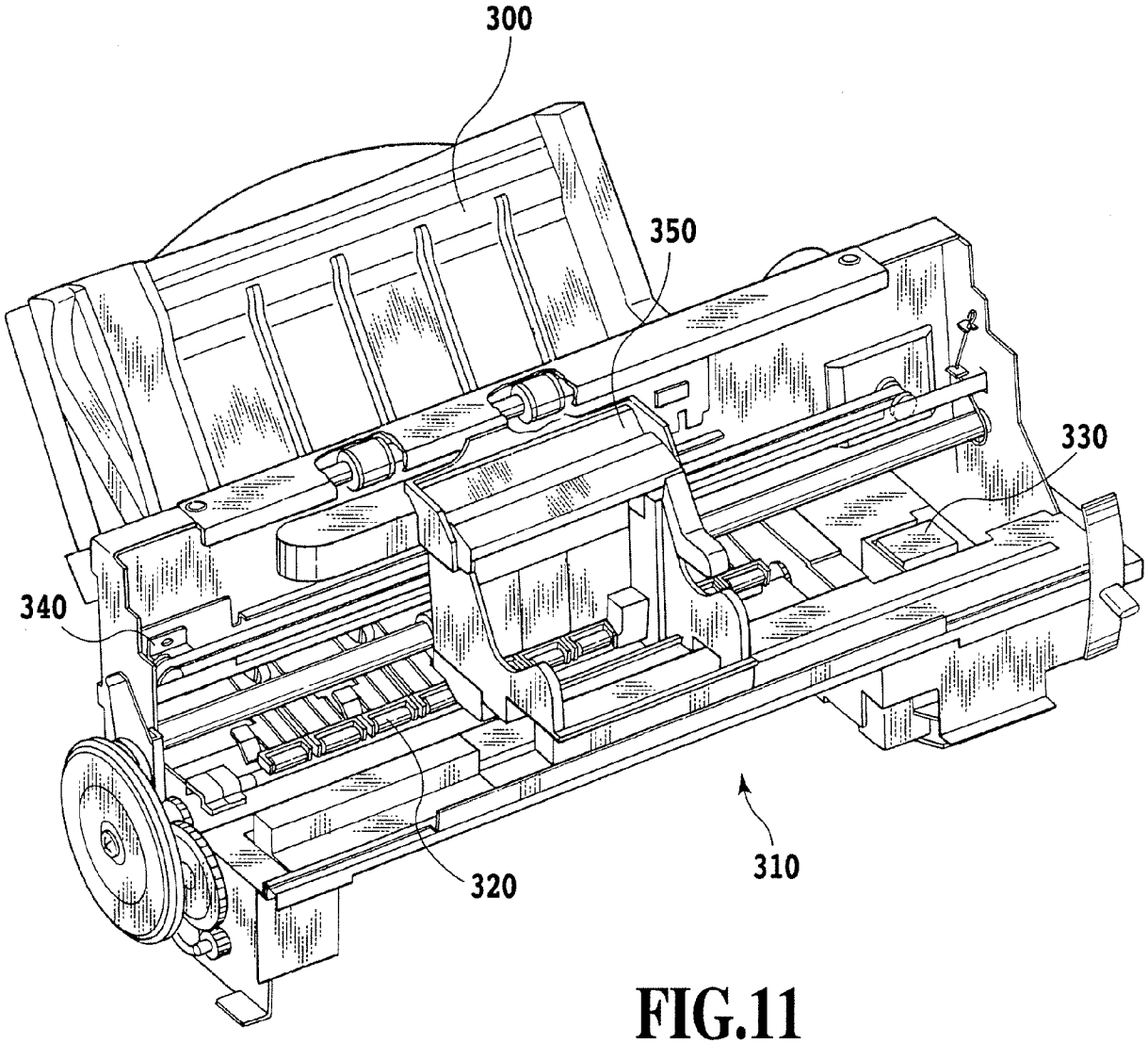
FIG. 11 is a perspective view illustrating a serial type ink jet recording apparatus.

FIG. 11 is a perspective view illustrating the structure of a serial type ink jet recording apparatus to which the present invention can be applied. The recording operation mechanism in this embodiment includes: the automatic paper feeding section 300 for automatically feeding a recording medium to the apparatus body; the transportation section 320 for guiding one recording medium sent from the automatic paper feeding section to a desired printing position and for guiding the medium from the printing position to the paper ejection section 310; a recording section for providing a desired printing to the recording medium transported to the transportation section; and the recovery section 330 for providing a recovery operation to the recording section. The recording section consists of the carriage 350 movably supported by the carriage axis 340 and the recording head cartridge H detachably attached to this carriage 350.

Figure 12:
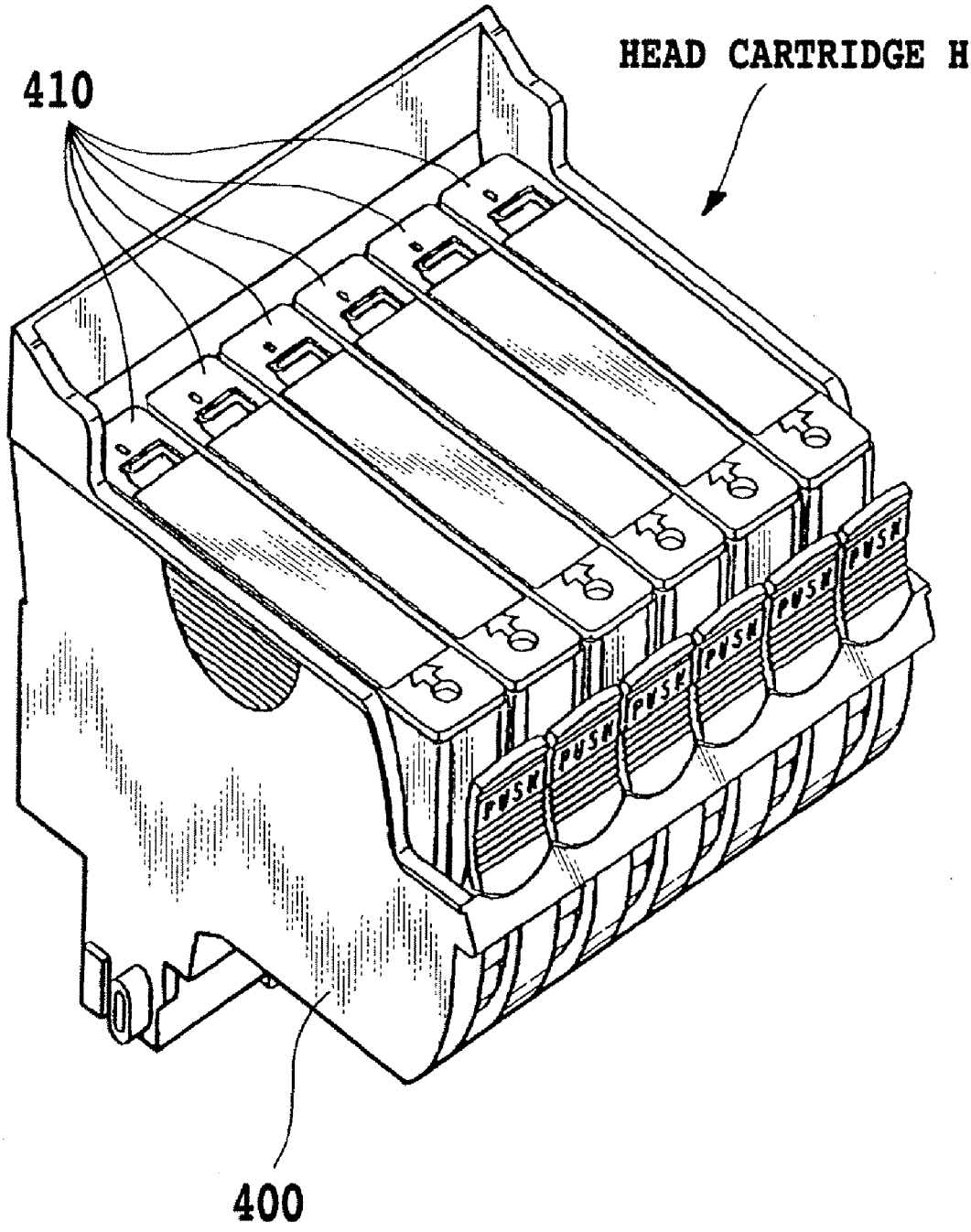
FIG. 12 illustrates a recording head cartridge that can be included in the ink jet recording apparatus shown in FIG. 11.

FIG. 12 shows an example of the structure of the head cartridge H that can be included in the ink jet recording apparatus shown in FIG. 11. The head cartridge H according to this embodiment has the recording head 400 for causing a nozzle to eject ink and the ink tank 410 for storing ink to supply ink to the recording head 400. The shown recording cartridge H includes the independent ink tanks of, for example, tanks for six colors of black (Bk), cyan (C), magenta (M), yellow (Y), photo-cyan (PC), and photo-magenta (PM). The respective ink tanks can be attached or detached to/from the recording head 400. The head cartridge H includes the same ink ejection section as that in FIG. 3.

The serial type recording apparatus requires a longer time for recording one medium when compared to the case of the full line type recording apparatus. Thus, the full line type is relatively suitable for an operation in which a large amount of media must be recorded within a short time. On the other hand, the serial type one is relatively suitable for family use because it can have a reduced size easily when compared to the case of the full line type one. Thus, a serial type recording apparatus for which the number of recording media for one recording operation is assumed to be relatively small has a mechanism in which the adjustment temperature is not minutely determined depending on the number of recording media but is changed in accordance with whether the number of recording media is equal to or higher than or lower than a specified value (10 in this embodiment).

Figure 13:
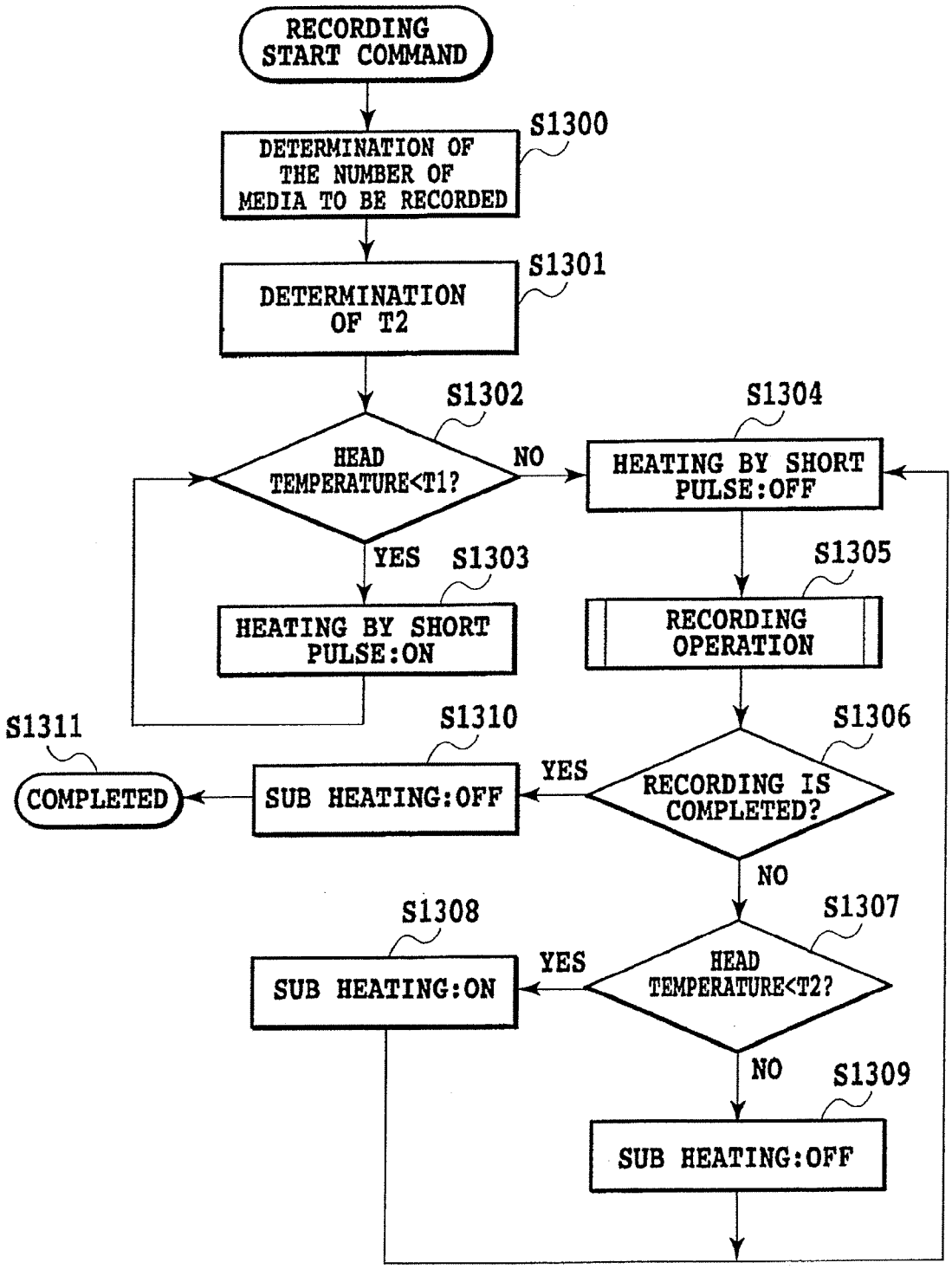
FIG. 13 is a flowchart illustrating the temperature adjustment control in Embodiment 4.

FIG. 13 is a flowchart illustrating the flow of the temperature adjustment control in this embodiment.

Embodiment 4 also uses the similar control system as that in Embodiment 1 in which the recording head includes, in addition to heaters for ink ejection, a sub heater for heating ink.

Embodiment 4 also uses ink as in Embodiment 1 that increases the first-ejection time as the temperature is increased. The respective head temperatures have a time during which a favorable ejection status can be maintained as shown in FIG. 6. The temperatures of the recording heads are changed In accordance with the temperature curve shown in FIG. 7.

The following section will describe a case in which a specified number of recording media is 10, the recording start temperature T1 is 25° C., and the adjustment temperature T2 is specified as 25° C. when 10 or less media are printed and is specified as 30° C. when 11 or more media are printed (see Table 4).

TABLE 4

| Recording start | Adjustment temperature T2 determined depending on the number of media to be printed | |
|---|---|---|
| temperature T1 | 10 or less | 11 or more |
| 25° C. | 25° C. | 30° C. |

The following section will describe a processing when the 10 or less media are printed.

Based on the to-be-recorded data and the recording start command sent from the host computer the system controller starts the temperature adjustment control of the recording head. First, the number of recording media is determined based on the to-be-recorded data (Step 1300). When 10 or less media are printed, the adjustment temperature T2 is set to be 25° C. and, when 11 or more media are printed, the adjustment temperature T2 is set to be 30° C. (Step 1301).

Then, the head temperature 18 detected (Step 1302). When the head temperature is lower than the recording start temperature T1, the ejection heater is driven with a short pulse to heat ink (Step 1303). When this heating operation provides a head temperature equal to or higher than T1, the heating with a short pulse is stopped (Step 1304), then starting the recording operation (Step 1305).

When the printing of the predetermined number of media is completed since the start of the recording operation (Step 1306) and when the head temperature has not yet reach the adjustment temperature T2 (Step 1307), then the sub heater is driven to heat ink (Step 1308). The recording is continued in this status. When the head temperature reaches the adjustment temperature T2, the sub heater stops heating ink (Step 1308). When the printing of the predetermined number of media is completed (Step 1306), the sub heater also stops heating ink (Step 1310). Then, the recording operation is completed (Step 1311).

When the number of recording media is higher than the specified value, the adjustment temperature is determined to be high to gets longer the first-ejection time, thus reducing the number of preliminary ejections. As a result, the recording time can be reduced and the amount of waste ink can be reduced.

(Others)

The above embodiments exemplarily described a case in which a recording medium having a cut sheet-like shape is printed such that temperature setting is performed depending on the number of media. However, the present invention also can be applied to a case where the recording is performed on a continuation paper (e.g., fan-folded paper, roll paper) or a to-be-recorded medium in which a sheet having a continuation paper-like shape is adhered with label sheets or the like. Specifically, the present invention can provide a temperature setting depending not only on "the number of media" but also on the amount of to-be-recorded media used for recording to-be-recorded data.

It is also understood that the number of color tones (color or density of Ink to be used) and the types of inks may be determined appropriately and the values and divided ranges of temperature in the above-described embodiments are also provided only for an illustrative purpose and do not limit the present invention.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-170462 filed Jun. 8, 2004, which is hereby incorporated by reference herein.

What is claimed is:

1. An ink jet recording apparatus for recording on recording media based on recording data by ejecting ink from a recording head, comprising:

determination means for determining, based on an amount of recording media to be recorded with the recording data, an adjustment temperature of the recording head, the adjustment temperature to be increased as the amount of the recording media is increased; and recording control means for maintaining, during the recording operation for recording of the recording data on the recording media, the recording head to have the determined adjustment temperature, wherein the recording control means changes, depending on the adjustment temperature, an interval with which a recovery processing is performed in a recording operation.

2. The ink jet recording apparatus according to claim 1, wherein the recording control means increases the interval with which the recovery processing is performed in a recording operation as the adjustment temperature is increased.

3. An ink jet recording apparatus for recording on recording media based on recording data by ejecting ink from a recording head, comprising:

determination means for determining, based on an amount of recording media to be recorded with the recording data, an adjustment temperature of the recording head, the adjustment temperature to be increased as the amount of the recording media is increased; and recording control means for maintaining, during the recording operation for recording of the recording data on the recording media, the recording head to have the determined adjustment temperature, wherein the recording control means starts a recording operation when a recording head temperature reaches a recording start temperature and, during the recording operation, maintains the recording head temperature to be the adjustment temperature, the recording start temperature is constant regardless of the number of recording media, and the recording control means changes the adjustment temperature during the recording operation in accordance with a number of the already-recorded media and maintains the recording head temperature to be the changed adjustment temperature.

4. An ink jet recording apparatus for recording on recording media based on recording data by ejecting ink from a recording head, comprising:

determination means for determining, based on an amount of recording media to be recorded with the recording data, an adjustment temperature of the recording head, the adjustment temperature to be increased as the amount of the recording media is increased; and recording control means for maintaining, during the recording operation for recording of the recording data on the recording media, the recording head to have the determined adjustment temperature, wherein the recording control means starts a recording operation when a recording head temperature reaches a recording start temperature and, during the recording operation, maintains the recording head temperature to be the adjustment temperature, the recording start temperature is constant regardless of the number of recording media, the recording control means maintains the recording head temperature at a first adjustment temperature when the amount of recording media is equal to or higher than a specified value, and maintains the recording head temperature at a second adjustment temperature when the amount of recording media is lower than the specified value, and the first determined temperature is higher than the second determined temperature.

5. An ink jet recording method for recording on recording media based on recording data by ejecting ink from a recording head, comprising:

a determination step for determining, based on an amount of recording media to be recorded with the recording data, an adjustment temperature of the recording head, the adjustment temperature to be increased as the amount of the recording media is increased; and a recording control step for maintaining, during the recording operation for recording of the recording data on the recording media, the recording head to have the determined adjustment temperature, wherein the recording control step changes, depending on the adjustment temperature, an interval with which a recovery processing is performed in a recording operation.

6. An ink jet recording method for recording on recording media based on recording data by ejecting ink from a recording head, comprising:

a determination step for determining, based on an amount of recording media to be recorded with the recording data, an adjustment temperature of the recording head, the adjustment temperature to be increased as the amount of the recording media is increased;

a recording control step for maintaining, during the recording operation for recording of the recording data on the recording media, the recording head to have the determined adjustment temperature, wherein the recording control step starts a recording operation when a recording head temperature reaches a recording start temperature and, during the recording operation, maintains the recording head temperature to be the adjustment temperature, the recording start temperature is constant regardless of the number of recording media, and the recording control step changes the adjustment temperature during the recording operation in accordance with a number of the already-recorded media and maintains the recording head temperature to be the changed adjustment temperature.

* * * * *

UNITED STATES PATENT AND TRADEMARK OFFICE

CERTIFICATE OF CORRECTION

PATENT NO. : 7,364,249 B2
APPLICATION NO. : 11/144705
DATED : April 29, 2008
INVENTOR(S) : Uji et al.

It is certified that error appears in the above-identified patent and that said Letters Patent is hereby corrected as shown below:

COLUMN 3:
Line 19, “it” should read --is--.
Line 33, “starts” should read --start--.
Line 54, “case latter” should read --latter case--.

COLUMN 5:
Line 25, “In” should read --in--.
Line 29, “ejections:” should read --ejections;--.

COLUMN 6:
Line 2, “11” should read --115--.

COLUMN 8:
Line 25, “the” (first occurrence) should be deleted.
Line 36, “every about” should read --about every--.
Line 38, “every about” should read --about every--.

COLUMN 9:
Line 2, “election” should read --ejection--.

COLUMN 10:
Line 16, “Ti” should read --T1--.
Line 54, “starts” should read --start--.

COLUMN 11:
Line 19, “(e.g.” should read --(e.g.,--.
Line 34, “Image” should read --image--.
Line 66, “Initial” should read --initial--.

COLUMN 12:
Line 21, “yet” should read --yet been--.
Line 54, “cooling” should read --cool--.
Line 59, “ejections to” should read --ejections is--.
Line 64, “ejections to” should read --ejections is--.

COLUMN 14:
Line 16, “In” should read --in--.
Line 36, “computer” should read --computer,--.
Line 44, “18” should read --is--.
Line 53, “reach” should read --reached--.

UNITED STATES PATENT AND TRADEMARK OFFICE

CERTIFICATE OF CORRECTION

PATENT NO. : 7,364,249 B2
APPLICATION NO. : 11/144705
DATED : April 29, 2008
INVENTOR(S) : Uji et al.

It is certified that error appears in the above-identified patent and that said Letters Patent is hereby corrected as shown below:

COLUMN 15:
Line 15, “Ink” should read --ink--.

Signed and Sealed this

Seventeenth Day of March, 2009

JOHN DOLL
*Acting Director of the United States Patent and Trademark Office*